US012637187B2

(12) United States Patent
Clabburn et al.

(10) Patent No.: US 12,637,187 B2
(45) Date of Patent: May 26, 2026

(54) WATERCRAFT SYSTEM WITH MODULAR HULL

(71) Applicant: BAE SYSTEMS plc, London (GB)

(72) Inventors: Lawrence Edward Clabburn, Barrow-in-Furness Cumbria (GB); Simon Phillip Newby, Barrow-in-Furness Cumbria (GB); David Charles Alexander Ritchie, Barrow-in-Furness Cumbria (GB)

(73) Assignee: BAE SYSTEMS PLC, London (GB)

( * ) Notice: Subject to any disclaimer, the term of this patent is extended or adjusted under 35 U.S.C. 154(b) by 365 days.

(21) Appl. No.: 18/563,531

(22) PCT Filed: May 25, 2022

(86) PCT No.: PCT/GB2022/051309

§ 371 (c)(1),
(2) Date: Nov. 22, 2023

(87) PCT Pub. No.: WO2022/254183

PCT Pub. Date: Dec. 8, 2022

(65) Prior Publication Data

US 2024/0217637 A1 Jul. 4, 2024

(30) Foreign Application Priority Data

Jun. 2, 2021 (EP) ..... 21275072
Jun. 2, 2021 (GB) ..... 2107866

(51) Int. Cl.
*B63G 8/04* (2006.01)

(52) U.S. Cl.
CPC ..... *B63G 8/04* (2013.01)

(58) Field of Classification Search
CPC ..... B63G 8/04
See application file for complete search history.

(56) References Cited

U.S. PATENT DOCUMENTS 2,806,441 A 9/1957 Hoke, Jr.
3,030,910 A 4/1962 Alsager
(Continued)

FOREIGN PATENT DOCUMENTS

DE 102004060010 B3 12/2005
DE 102017200078 A1 7/2018
(Continued)

OTHER PUBLICATIONS

International Search Report and Written Opinion received for PCT/GB2022/051309. Mailed: Jul. 8, 2022. 10 pages.
(Continued)

*Primary Examiner* — Jess Whittington
(74) *Attorney, Agent, or Firm* — Arcane Law PLLC

(57) ABSTRACT

A watercraft system includes a hull having a longitudinal axis which extends between an aft end and a forward end. The hull includes at least a first hull module and a second hull module. The first hull module may define the aft end and a first interface element which defines a first hull module opening. The second hull module may define the forward end and a second interface element which defines a second hull module opening. The first interface element and second interface element being configured to couple with each other to form a sealed joint. The first interface element and second interface element may be configured to be uncoupled from one another.

16 Claims, 3 Drawing Sheets

(56) References Cited

U.S. PATENT DOCUMENTS

| | | | | |
|---|---|---|---|---|
| 3,302,602 | A | 2/1967 | Korganoff | |
| 3,521,589 | A | 7/1970 | Kemp | |
| 3,598,074 | A | 8/1971 | Schubert | |
| 3,934,531 | A * | 1/1976 | Allen | B63B 35/70 114/63 |
| 4,831,297 | A | 5/1989 | Taylor et al. | |
| 5,152,240 | A | 10/1992 | Fontanille | |
| 5,257,952 | A | 11/1993 | Veronesi et al. | |
| 5,477,797 | A * | 12/1995 | Stuart | B63B 3/20 114/65 R |
| 5,505,155 | A | 4/1996 | Adams | |
| 6,345,581 | B2 * | 2/2002 | Blanchard | B63B 3/08 114/77 R |
| 7,146,921 | B2 | 12/2006 | Fontanille et al. | |
| 8,474,393 | B1 * | 7/2013 | Chandler | B63B 7/04 114/77 R |
| 8,677,920 | B1 | 3/2014 | Jeng | |
| 9,193,424 | B2 | 11/2015 | Lee | |
| 11,420,715 | B1 * | 8/2022 | Simard | B63B 13/02 |
| 11,745,840 | B1 * | 9/2023 | Seeley | H01R 12/7005 439/866 |
| 11,760,454 | B1 * | 9/2023 | Seeley | B63G 8/14 114/330 |
| 11,904,993 | B1 * | 2/2024 | Seeley | B63H 23/34 |
| 2002/0178990 | A1 | 12/2002 | McBride et al. | |
| 2003/0167998 | A1 | 9/2003 | Huntsman | |
| 2008/0092792 | A1 * | 4/2008 | Keck | B63B 1/38 114/61.1 |
| 2010/0010703 | A1 | 1/2010 | Coats et al. | |
| 2010/0230545 | A1 * | 9/2010 | Huber | B64C 1/20 244/137.1 |
| 2011/0061585 | A1 * | 3/2011 | Kopylov | B63C 13/00 114/344 |
| 2012/0024220 | A1 * | 2/2012 | Keck | B63B 1/38 114/65 R |
| 2014/0318435 | A1 * | 10/2014 | Murray, III | B63H 21/30 114/77 R |
| 2021/0031744 | A1 * | 2/2021 | Allen | B63B 25/28 |
| 2021/0155335 | A1 * | 5/2021 | Zhou | B64B 1/04 |
| 2021/0291938 | A1 * | 9/2021 | Michaeli | B63B 27/143 |
| 2024/0217636 | A1 | 7/2024 | Newby et al. | |
| 2024/0246650 | A1 | 7/2024 | Clabburn et al. | |
| 2024/0253501 | A1 | 8/2024 | Clabburn et al. | |

FOREIGN PATENT DOCUMENTS

| | | | |
|---|---|---|---|
| EP | 0945336 | A1 | 9/1999 |
| EP | 2471707 | A2 | 7/2012 |
| EP | 2811543 | A1 | 12/2014 |
| EP | 2246252 | A2 | 5/2019 |
| EP | 2972170 | B1 | 7/2020 |
| FR | 2742120 | A1 | 6/1997 |
| FR | 3012790 | A1 | 5/2015 |
| JP | H07223589 | A | 8/1995 |
| WO | 01/21476 | A1 | 3/2001 |
| WO | 2008088290 | A1 | 7/2008 |
| WO | 2010083885 | A1 | 7/2010 |
| WO | 2014170635 | A1 | 10/2014 |
| WO | 2016087090 | A1 | 6/2016 |
| WO | 2017153580 | A1 | 9/2017 |
| WO | 2022254176 | A1 | 12/2022 |
| WO | 2022254180 | A1 | 12/2022 |
| WO | 2022254183 | A1 | 12/2022 |
| WO | 2022254184 | A1 | 12/2022 |

OTHER PUBLICATIONS

GB Search Report under Section 17(5) received for GB Application No. 2107866.2 dated Mar. 17, 2022. 4 pages.

Extended European Search Report received for EP Application No. 21275072.3 dated Dec. 15, 2021. 7 pages.

Vavasseur, Xavier, "Sevmash to Start Using Modular Technology for Submarine Construction," NavalNews, (Oct. 13, 2020). 4 pages. Retrieved from the Internet on Dec. 6, 2021 at: URL: https://www.navalnews.com/naval-news/2020/10/sevmash-to-start-using-modular-technology-for-submarine-construction/.

* cited by examiner

WATERCRAFT SYSTEM WITH MODULAR HULL

FIELD

The present disclosure relates to a watercraft system.

In particular it relates to a submarine or a submersible comprising a number of modules that may be assembled and disassembled.

BACKGROUND

It is known to alter the configuration of vehicles by disassembling and then reassembling them to include additional or alternative components. For large vehicles which must be water and/or airtight, for example a watercraft, typically this is done by splitting a hull by cutting through it, inserting a section, and then welding the new combination of sections together. Hence typically the joins made between the sections of the hull are permanent, and configured to be made only once and kept that way for the rest of the life of the watercraft.

Additionally equipment inside a watercraft may need replacing for repair and/or to be upgraded, which is typically done by dismantling the equipment and removing it through existing hatches and doorways. If the equipment is large, it may instead be removed and replaced by cutting a hole in the side of the watercraft which is later closed by attaching a plate with a welding process.

Such conventional methods take a great deal of time and must be done very carefully to ensure rest of the watercraft is adequately supported while the hull is weakened. Also such conventional methods can only be done a small number of times before the integrity of the watercraft is reduced.

As such significant work happens rarely in the life of a large vessel, conventional methods are entirely adequate. However where testing of different variants of a watercraft, or frequent changes in operational requirements of a watercraft arise, conventional reconfiguration methods mean that a vessel can only be adapted a small number of times before its configuration cannot be significantly further adjusted, and an alternative vessel must be used.

Hence a watercraft system which may be re-configured easily and repeatedly is highly desirable.

SUMMARY

According to the present disclosure there is provided an apparatus and method as set forth in the appended claims. Other features of the invention will be apparent from the dependent claims, and the description which follows.

Accordingly there may be provided a watercraft system (10). The watercraft system (10) is a submarine or a submersible configured to be submerged in water. The watercraft system (10) comprises a hull (12). The hull (12) has a longitudinal axis (14) which extends between an aft end (16) and a forward end (18). The hull (12) comprises at least a first hull module (100) and a second hull module (200). The first hull module (100) defines the aft end (16). The first hull module (100) defines a first interface element (102) which may define a first hull module opening (106). The second hull module (200) defines the forward end (18). The second hull module (200) defines a second interface element (202) which may define a second hull module opening (206). The first interface element (102) and second interface element (202) are configured to couple with each other to form a sealed joint. The first interface element (102) and second interface element (202) are configured to be uncoupled from one another. The watercraft system (10) is operable with the first interface element (102) of the first hull module (100) coupled to the second interface element (202) of the second hull module (200). The watercraft system (10) is operable with the first hull module (100) and the second hull module (200) coupled together by a third hull module (300) provided between the first hull module (100) and the second hull module (200). The third hull module (300) is configured to be uncoupled from the first hull module (100) and second hull module (200).

The hull may comprise the third hull module (300). The third hull module (300) may have two ends (316, 318). The third hull module (300) may have a third interface element (302) at one end (316) which defines a third hull module first opening (306) and a fourth interface element (304) at the other end (318) which defines a third hull module second opening (308). The first interface element (102) of the first hull module (100) may be configured to couple with the fourth interface element (304) of the third hull module (300) to form a sealed joint. The first interface element (102) of the first hull module (100) may be configured to be uncoupled from the fourth interface element (304) of the third hull module (300). The second interface element (202) of the second hull module (200) may be configured to couple with the third interface element (302) of the third hull module (300) to form a sealed joint. The second interface element (202) of the second hull module (200) may be configured to be uncoupled from the third interface element (302) of the third hull module (300).

The hull may comprise the third hull module (300). The third hull module (300) may have two ends (316, 318). The third hull module (300) may have a third interface element (302) at one end which defines a third hull module first opening (306) and a fourth interface element (304) at the other end which defines a third hull module second opening (308). The first interface element (102) of the first hull module (100) and second interface element (202) of the second hull module (200) may be configured to couple with each of the third interface element (302) and fourth interface element (304) of the third hull module (300) to form a sealed joint. The first interface element (102) of the first hull module (100) and second interface element (202) of the second hull module (200) may be configured to be uncoupled from each of the third interface element (302) and fourth interface element (304) of the third hull module (300).

The second hull module (200) may comprise a first sub-module (220) and second sub-module (230). The first sub-module (220) may have a fifth interface element (222) which defines a first sub-module opening (226). The second sub-module (230) may have a sixth interface element (232) which defines a second sub-module opening (236). The fifth interface element (222) of the first sub-module (220) and sixth interface element (232) of the second sub-module (230) may be configured to couple with each other to form a sealed joint. The fifth interface element (222) of the first sub-module (220) and sixth interface element (232) of second sub-module (230) may be configured to uncouple from each other.

The first hull module (100), third hull module (300) and second hull module first sub-module (220) may be provided in series along the longitudinal axis (14). The second hull module second sub-module (230) may extend from the second hull module first sub-module (220) in a direction perpendicular to the longitudinal axis (14).

The second hull module second sub-module (230) may be a bridge fin (240).

Adjacent interface elements of the hull modules may be coupled by a fixing means (400). The fixing means (400) may have a first configuration in which the adjacent interface elements are coupled with one another. The fixing means (400) may have a second configuration in which the adjacent interface elements are operable to be un-coupled from one another.

The fixing means 400 may comprise a threaded nut and threaded bolt.

The or each fixing means 400 may comprise an assembly of a threaded bolt, a reaction nut and a tension nut.

The watercraft system (10) may further comprise an equipment module (500). At least one of the hull modules may be provided with a mounting rail (502) for carrying the equipment module (500). The mounting rail (502) may extend in a direction aligned with, or parallel to, the hull longitudinal axis (14) along the inside of the hull module. The equipment module (500) may be slidable along the mounting rail (502) to move in a direction along the longitudinal axis (14) into and out of the respective opening in the respective hull module.

The equipment module (500) and mounting rail (502) may be configured to be engaged with one another to secure the equipment module (500) and mounting rail (502) together. The equipment module (500) and mounting rail (502) may be configured to be disengaged from one another so that the equipment module (500) can be removed from the respective hull module in a direction along the longitudinal axis (14).

The equipment module (500) may comprise a support structure (504) and an equipment unit (506). The equipment unit (506) may be mounted to the support structure (504). The equipment unit (506) may comprise one of: a power plant; an engine; a battery; instrumentation; control equipment; furniture; or crew quarters.

The support structure (504) may be operable to engage with/slide along the mounting rail (502).

There may be further provided a method of operation of a watercraft system (10), wherein the watercraft system (10) is a submarine or a submersible configured to be submerged in water; the watercraft system (10) comprising a hull (12) having a longitudinal axis (14) which extends between an aft end (16) and a forward end (18); the hull (12) comprising at least a first hull module (100) and a second hull module (200); wherein the first hull module (100) defines the aft end (16), and a first interface element (102) which defines a first hull module opening (106); and the second hull module (200) defines the forward end (18) and a second interface element (202) which defines a second hull module opening (206); the method comprising at least one of the steps of: coupling the first interface element (102) and second interface element (202) to form a sealed joint; uncoupling the first interface element (102) and second interface element (202) and separating the hull modules.

The method may further comprise the step of: providing a third hull module (300) having a third interface element (302) at one end which defines a third hull module first opening (306) and a fourth interface element (304) at the other end which defines a third hull module second opening (308); coupling the first interface element (102) of the first hull module (100) with the fourth interface element (304) of the third hull module (300) to form a sealed joint; coupling the second interface element (202) of the second hull module (200) with the third interface element (302) of the third hull module (300) to form a sealed joint.

The watercraft system (10) may further comprise a mounting rail (502) for carrying an equipment module (500); the mounting rail (502) extending in a direction aligned with, or parallel to, the hull longitudinal axis (14) along the inside of the hull module; and the method may further comprise the step of: entering a first equipment module (500) through the respective opening in the hull module and sliding the first equipment module (500) along the mounting rail (502) to move in a direction along the longitudinal axis (14); and locking the equipment module (500) in position relative to the hull module.

The method may further comprise the step of removing the first equipment module (500) from the hull module by sliding the first equipment module (500) along the mounting rail (502) to move in a direction along the longitudinal axis (14) out of the respective opening in the hull module.

The method may further comprise the step of: entering a second equipment module (500) through the respective opening in the hull module and sliding the second equipment module (500) along the mounting rail (502) to move in a direction along the longitudinal axis (14); and locking the second equipment module (500) in position relative to the hull module.

The method may comprise the step of transporting the hull modules in a dis-assembled state.

Hence there may be provided watercraft system constructed from a number of hull modules that may be uncoupled from one another and re-assembled in a different configuration. The watercraft system according to the present disclosure is alternatively or additionally operable to be disassembled so that additional and/or replacement equipment for the operation of the watercraft system, or equipment that requires testing, may be located in the watercraft system.

Hence, in the example of a submarine or submersible, the splitting of its hull, where the hull may comprise a pressure hull, enables removal and replacement of equipment rafts/modules for the purpose of operational capability re-role or rapid insertion of technology for operational testing.

Additionally by virtue of modules and sub-modules of the watercraft system according to the present disclosure being configured to be uncoupled from one another and then reassembled, is may be more easily transported in a faster vehicle (for example an aircraft) or over land where such may be quicker or easier than travelling by water.

BRIEF DESCRIPTION OF THE FIGURES

Examples of the present disclosure will now be described with reference to the accompanying drawings, in which.

DETAILED DESCRIPTION

Figure 1:
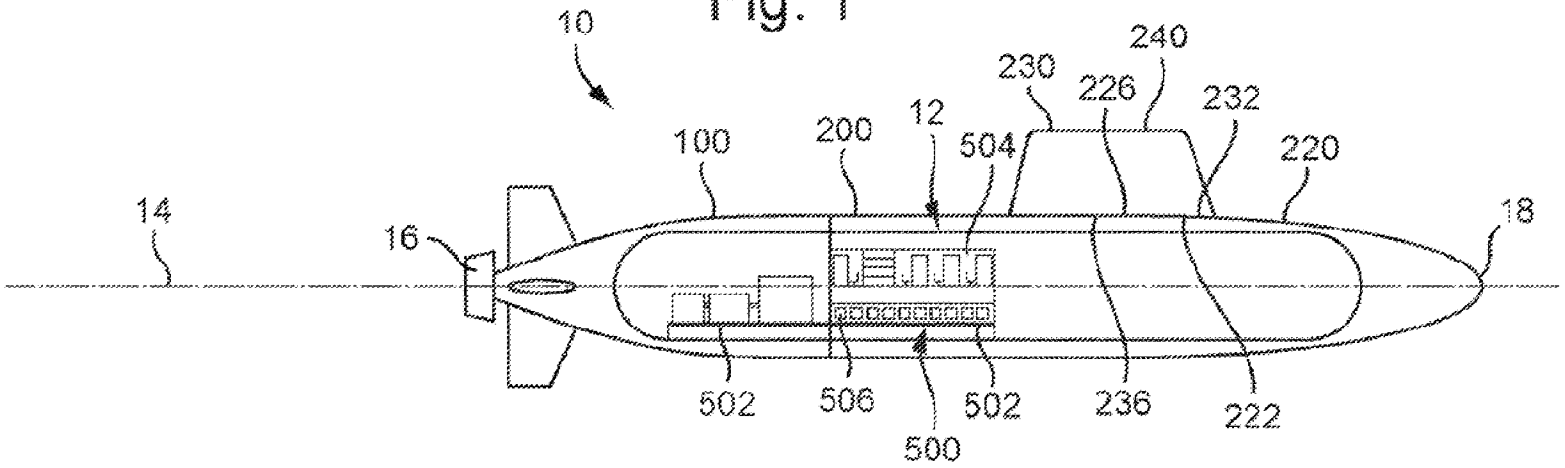
FIG. 1 shows a watercraft system of a first hull module coupled to a second hull module of the present disclosure.

A watercraft system 10 according to the present disclosure comprises a number of hull modules that may be uncoupled from one another and re-assembled in a different configuration and/or with a different number of modules. The watercraft system according to the present disclosure is alternatively or additionally operable to be disassembled so that additional and/or replacement equipment for the operation of the watercraft system, or equipment that requires testing, may be located in the watercraft system.

The watercraft system 10 is illustrated with reference to FIGS. 1 to 5. The watercraft system 10 of the present disclosure may be, as illustrated, a submarine (e.g. a submersible configured to be submerged in water). The watercraft system 10 comprises a water/air tight sealable hull 12, for example a pressure hull, having a longitudinal axis 14. Hence the hull 12 defines a pressure vessel. The watercraft system 10 and/or the hull 12 extends between an aft end 16 and a forward end 18. The aft end 16 is spaced apart from the forward end 18 by the longitudinal axis 14.

As shown in FIGS. 1 to 5, the hull 12 comprises at least a first hull module 100 and a second hull module 200. As set out below, and shown in the figures, the hull 12 may additionally or alternatively comprise additional hull modules, for example at least a third hull module 300. Further additional modules may also be provided.

The first hull module 100 defines the aft end 16, and hence may be closed at the aft end 16. The first hull module 100 comprises a first interface element 102 (for example flange or other joining interface feature) which defines, bounds and/or extends around a first hull module opening 106. That is to say, the first hull module 100 may have a first hull module opening 106, which is bounded by the first interface element 102.

The second hull module 200 defines the forward end 18, and hence may be closed at the forward end 18. The second hull module 200 comprises a second interface element 202 (for example flange or other joining interface feature) which defines, bounds and/or extends around a second hull module opening 206. That is to say, the second hull module 200 may have a second hull module opening 206, which is bounded by the second interface element 202.

Hence each of the first hull module 100 and second hull module 200 define a cavity (i.e. a sub-chamber) which is delimited at one end by the respective interface element 102, 202. That is to say, the first hull module 100 defines a cavity (i.e. a sub-chamber) which has an opening 106 at one end, and the second hull module 200 defines a cavity (i.e. a sub chamber) which has an opening 206 at one end.

Figure 2:
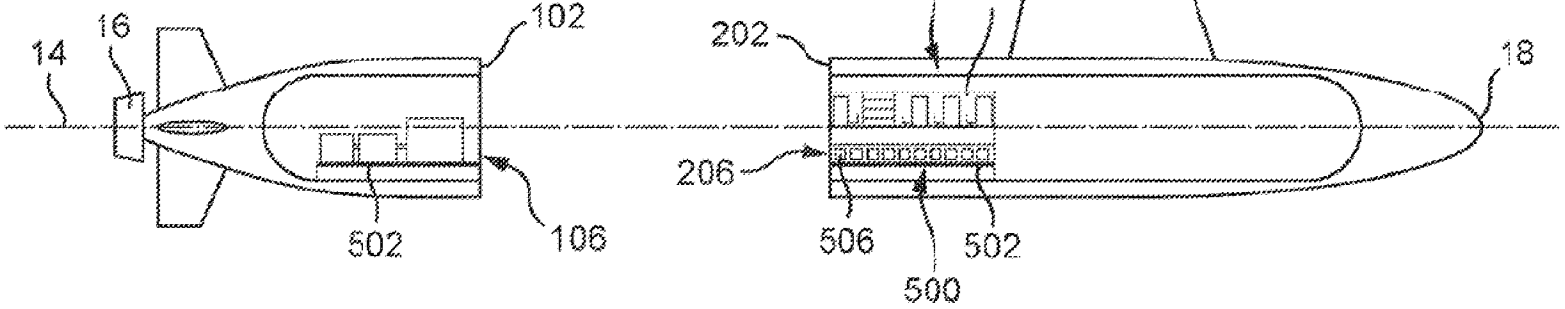
FIG. 2 shows the first hull module uncoupled and spaced apart from the second hull module.

The first interface element 102 and second interface element 202 are configured and operable to couple/engage with each other to form a sealed joint, as illustrated in FIG. 1, so that the sub-chambers of each module form larger chamber. The first interface element 102 and second interface element 202 are configured and operable to be uncoupled from one another as shown in FIG. 2.

Hence the watercraft system 10 according to the present disclosure is operable as a vessel (e.g. submarine or a submersible configured to be submerged in water) with the first interface element 102 of the first hull module 100 coupled to the second interface element 202 of the second hull module 200 as shown in FIG. 1.

Figure 5:
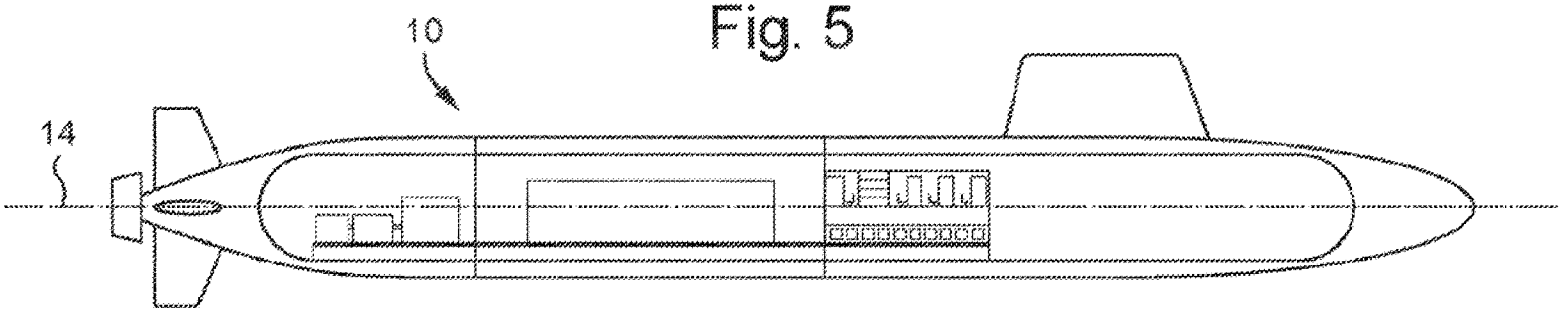
FIG. 5 shows a watercraft system assembly of the first hull module, second hull module and third hull module of the present disclosure.

Additionally the watercraft system 10 according to the present disclosure is operable as a vessel (e.g. submarine or a submersible configured to be submerged in water) with the first hull module 100 and the second hull module 200 coupled together by at least one additional module 300 (e.g. a third module 300) provided between the first hull module 100 and the second hull module 200 as shown in FIG. 5. In such an example the at least one additional module (e.g. a third module 300) is configured to be uncoupled from the first hull module 100 and second hull module 200.

Figure 3:
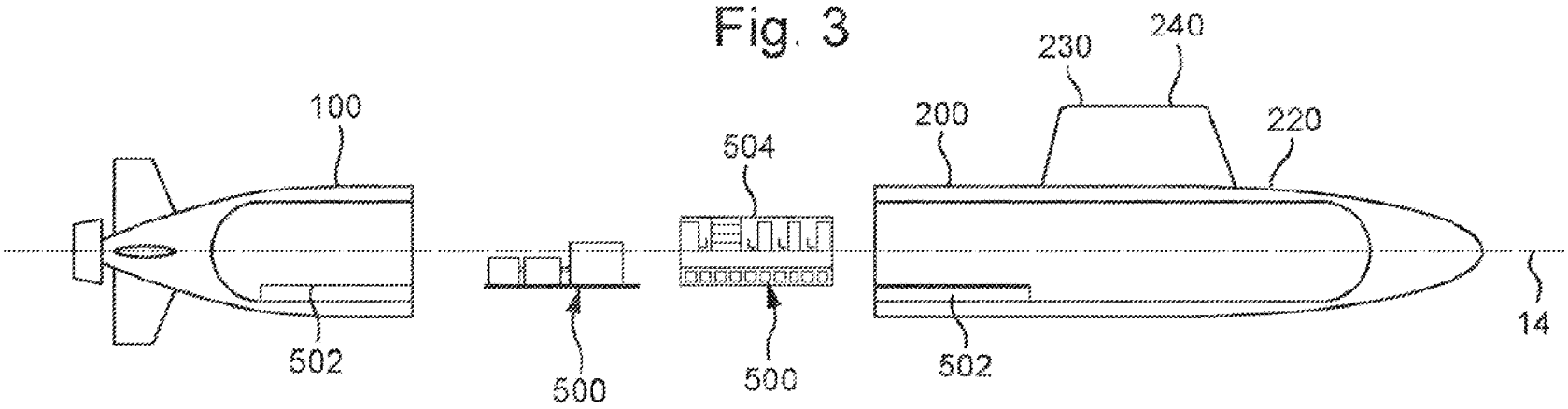
FIG. 3 shows the arrangement of FIG. 2 with equipment modules removed from the first hull module and second hull module.
Figure 4:
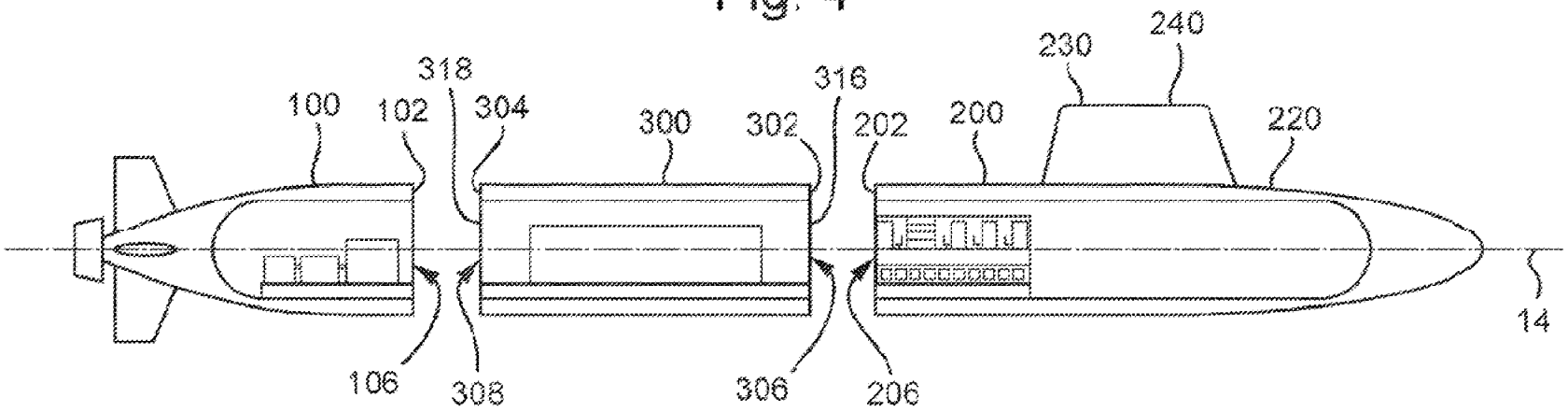
FIG. 4 shows the first hull module and second hull module aligned with a third hull module prior to being coupled to form a reconfigured watercraft system.

Hence the hull 12 of the watercraft system 10 may adapted (e.g. reconfigured, extended) to include the third hull module 300. In such an example, and as shown in FIGS. 3 to 5, the third hull module 300 has two ends 316, 318. The third hull module 300 may have a third interface element 302 (for example flange or other joining interface feature) at one end 316 which defines, bounds and/or extends around a third hull module first opening 306, and a fourth interface element 304 (for example flange or other joining interface feature) at the other end 318 which defines, bounds and/or extends around a third hull module second opening 308. That is to say, the third hull module 300 may have a third hull module first opening 306, which is bounded by the third interface element 302, and/or a third hull module second opening 308, which is bounded by the fourth interface element 304.

Hence the third hull module 300 defines a cavity (i.e. a sub-chamber) which is delimited at either end by the respective interface elements 302, 304. That is to say, the third hull module 300 defines a cavity (i.e. a sub-chamber) which has openings 306, 308 at opposite ends.

In one example, the first interface element 102 of the first hull module 100 is configured and operable to couple (e.g. engage) with the fourth interface element 304 of the third hull module 300 to form a sealed joint, and the first interface element 102 of the first hull module 100 is configured to be uncoupled from the fourth interface element 304 of the third hull module 300. The second interface element 202 of the second hull module 200 is configured to couple with the third interface element 302 of the third hull module 300 to form a sealed joint, and the second interface element 202 of the second hull module 200 is configured and operable to be uncoupled (e.g. disengaged) from the third interface element 302 of the third hull module 300.

Additionally or alternatively the first interface element 102 of the first hull module 100 and second interface element 202 of the second hull module 200 is configured and operable to couple (e.g. engage) with each of the third interface element 302 and fourth interface element 304 of the third hull module 300 to form a sealed joint, and the first interface element 102 of the first hull module 100 and second interface element 202 of the second hull module 200 are configured and operable to be uncoupled (e.g. disengaged from) each of the third interface element 302 and fourth interface element 304 of the third hull module 300.

The second hull module 200 may comprise a first sub-module 220 and a second sub-module 230, each defining a sub-chamber. In the examples of FIGS. 1 to 5, the second hull module second sub-module 230 is a bridge fin 240.

The first sub-module 220 may have a fifth interface element 222 (for example flange or other joining interface feature) which defines, bounds and/or extends around a first sub-module opening 226 to its sub-chamber. The second sub-module 230 may have a sixth interface element 232 (for example flange or other joining interface feature) which defines, bounds and/or extends around a second sub-module opening 236 to its respective sub-chamber. The fifth interface element 222 of the first sub-module 220 and sixth interface element 232 of the second sub-module 230 may be configured and operable to couple (e.g. engage) with each other to form a sealed joint to link the sub-chambers to form a larger chamber. Additionally, the fifth interface element 222 of the first sub-module 220 and sixth interface element 232 of second sub-module 230 are configured and operable to uncouple (e.g. dis-engage) from each other.

As shown in FIGS. 4, 5 the first hull module 100, third hull module 300 and second hull module first sub-module 220 are provided in series along the longitudinal axis 14.

As shown in FIGS. 1 to 5 the second hull module second sub-module 230 extends from the second hull module first sub-module 220 in a direction perpendicular to the longitudinal axis 14.

The openings in each module and sub-module are sized according to need. However, they may be at least large enough for a crew member to pass through. At least one of the openings may be substantially the same as the internal diameter of it respective sub-chamber.

Adjacent interface elements of the hull modules are coupled (e.g. joined together) by a fixing means 400 which extend therebetween. The fixing means 400 may have a first configuration in which the adjacent interface elements are coupled (e.g. engaged) with one another. The fixing means 400 may have a second configuration in which the adjacent interface elements are operable to be un-coupled (e.g. disengaged) from one another. Hence the fixing means are configured to join and the hull modules (and sub-modules) together, and also configured and operable to be dis-engageable to allow the hull modules (and sub-modules) to be disconnected from one another.

The fixing means 400 may be provided as a nut and bolt (or stud), or other appropriate fixing which allows the for engagement and disengagement. Hence the fixing means 400 may comprise a threaded nut and threaded bolt. The or each fixing means 400 may comprise an assembly of a threaded bolt, a reaction nut and a tension nut.

As shown in FIGS. 1 to 5, the watercraft system 10 may further comprise an equipment module 500. At least one of the hull modules is provided with a mounting rail 502 for carrying the equipment module 500. Hence a mounting rail 502 may be provided within the sub-chamber of at least one of the hull modules, for example fixed to a wall or mount within the sub-chamber hull module.

The mounting rail 502 may extend in a direction aligned with, or parallel to, the hull longitudinal axis 14 along the inside of the respective hull module.

The equipment module 500 may be slidable along the mounting rail 502 to move in a direction along the longitudinal axis 14 into and out of the respective opening in the respective hull module. That is to say, the equipment module 500 may be slidable along the mounting rail 502 to move in a first direction along the longitudinal axis 14 into and through the respective opening in the respective hull module, and the equipment module 500 may be slidable along the mounting rail 502 to move in a second direction along the longitudinal axis 14 out of and through the respective opening in the respective hull module. The second direction may be opposite to the first direction.

The equipment module 500 and mounting rail 502 may be configured to be engaged with one another to secure the equipment module 500 and mounting rail 502 together. The equipment module 500 and mounting rail 502 are configured to be disengaged from one another so that the equipment module 500 can be removed from the respective hull module in a direction along the longitudinal axis 14.

The equipment module 500 may comprise a support structure 504 and an equipment unit 506, the equipment unit 506 mounted to the support structure 504. The equipment unit 506 may comprise one of: a power plant; an engine; a battery; instrumentation; control equipment; furniture; or crew quarters.

The support structure 504 may comprise a framework, for example space frame, which is operable to engage with/slide along the mounting rail 502.

A method of operation of a watercraft system 10 according to the present disclosure may comprise the step of coupling the first interface element 102 of the first hull module 100 and second interface element 202 of the second hull module 200 to form a sealed joint between the first hull module 100 and the second hull module 200. That is to say, the method of operation of a watercraft system 10 according to the present disclosure may comprise the step of coupling the first interface element 102 of the first hull module 100 and second interface element 202 of the second hull module 200 to form a sealed joint between the first interface element 102 of the first hull module 100 and second interface element 202 of the second hull module 200 to form a sealed (i.e. water/air tight) chamber.

A method of operation of a watercraft system 10 according to the present disclosure may comprise the step of uncoupling the first interface element 102 of the first hull module 100 and second interface element 202 of the second hull module 200 and separating the first hull module 100 and the second hull module 200.

A method of operation of a watercraft system 10 according to the present disclosure may comprise the step of providing the third hull module 300 and coupling the first interface element 102 of the first hull module 100 with the fourth interface element 304 of the third hull module 300 to form a sealed joint between the first hull module 100 and the third hull module 300, and coupling the second interface element 202 of the second hull module 200 with the third interface element 302 of the third hull module 300 to form a sealed joint between the second hull module 200 and the third hull module 300. That is to say, the method of operation of the watercraft system 10 according to the present disclosure may comprise the step of coupling the first interface element 102 of the first hull module 100 with the fourth interface element 304 of the third hull module 300 to form a sealed joint between the first interface element 102 of the first hull module 100 and the fourth interface element 304 of the third hull module 300, and coupling the second interface element 202 of the second hull module 200 with the third interface element 302 of the third hull module 300 to form a sealed joint between the second interface element 202 of the second hull module 200 with the third interface element 302 of the third hull module 300 to form a sealed (i.e. water/air tight) chamber.

A method of operation of a watercraft system 10 according to the present disclosure may comprise the step of entering a first equipment module 500 through one of the watercraft hull module openings and sliding the first equipment module 500 along the mounting rail 502 to move in a direction along the longitudinal axis 14, and securing (e.g. locking) the equipment module 500 in position relative to the respective hull module.

The method may further comprise the step of removing the first equipment module 500 from the hull module by sliding the first equipment module 500 along the mounting rail 502 to move in a direction along the longitudinal axis 14 out of the opening in the respective hull module.

The method may further comprise the step of entering a second equipment module 500 through the respective opening in the hull module and sliding the second equipment module 500 along the mounting rail 502 to move in a direction along the longitudinal axis 14, and securing (e.g. locking) the second equipment module 500 in position relative to the hull module. The second equipment module 500 may comprise the same equipment as the first equipment module (albeit a direct replacement, for example a replacement engine), an updated version or different equipment (for example, swapping crew quarters for instrumentation).

The method of operation may comprise the step of transporting the hull modules in a dis-assembled state. That is to say, the hull modules and (where present, sub modules) may be taken apart so they may be packed into another vehicle for transport.

Hence there is provided a watercraft system 10 comprising modular (and optionally sub-modular) hull sections which may be coupled and uncoupled when required, many times.

This enables the volumetric size (i.e. capacity) of the watercraft system 10 to be adjusted.

This also enables equipment inside the watercraft system 10 to moved, removed, replaced, fitted as required. This has significant maintenance advantages since it means that any equipment which needs to be repaired, reconfigured, updated and/or fixed can be entirely removed from the watercraft system 10 so that it may be worked on more easily outside of the vehicle. This also means that a substitute equipment module 500 can be installed in the watercraft system 10 to get it operational as soon as possible rather than waiting for the former module 500 to be repaired.

For example, being able to assemble and dissemble the hull modules (for example using nut and bolt (or stud) to fix them together allows the aft end of watercraft to be rapidly removed for the purposes of easy maintenance and replacement of an external motor drive unit and control surface actuation systems, and rapid re-configuration of the aft end of the submarine to investigate improved stern plane and propulsion concepts.

The ability to increase and reduce the number of whole modules and sub-modules making up the watercraft system 10 also provides great operational flexibility. Hence a watercraft system 10 may be quickly configured to meet the needs of a particular operational role or test by adapting the watercraft system 10 to have the required number of hull modules to fit the desired amount of equipment.

Figure 6:
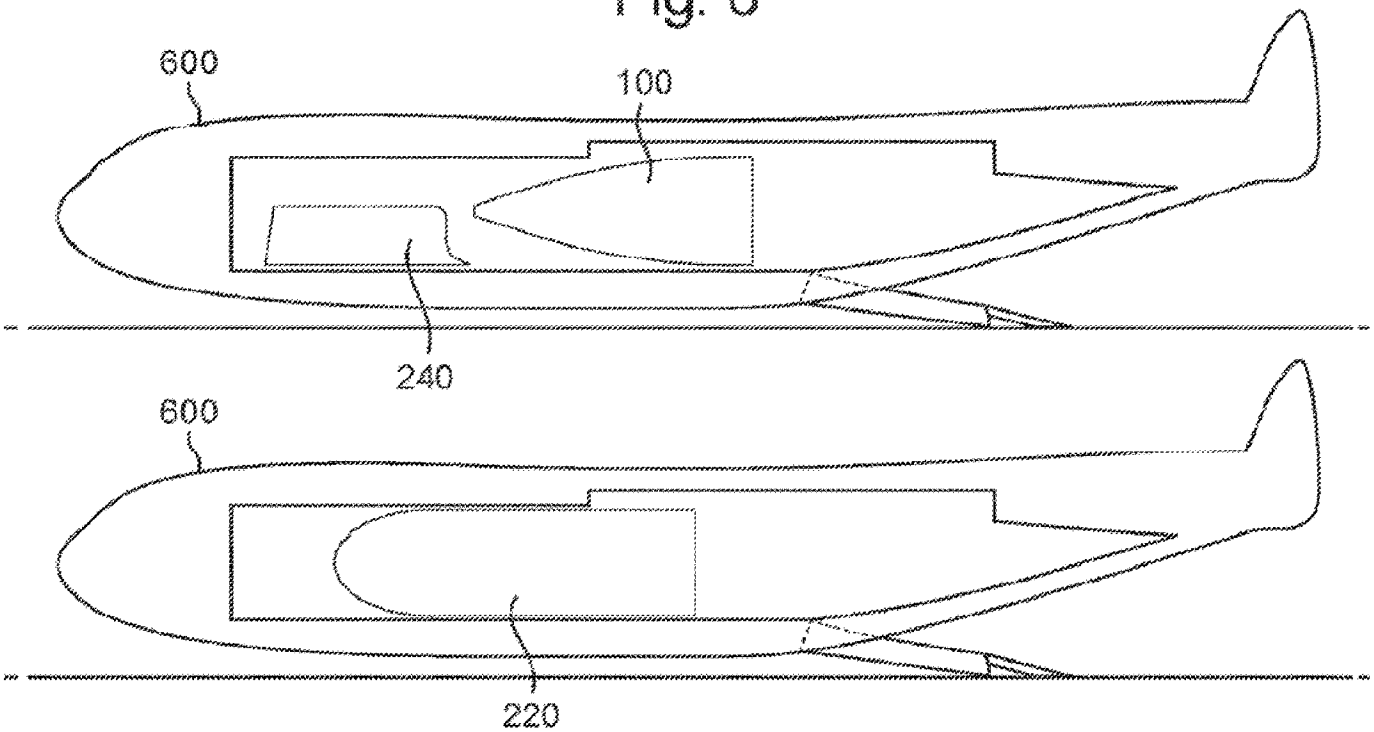
FIG. 6 shows disassembled modules of the watercraft assembly in an aircraft.

Additionally the modular nature of the watercraft system 10, and that the modules are configured to be coupled and decoupled from one another, means that the watercraft can be transported more easily in a further vehicle, for example an aircraft 600. FIG. 6 illustrates an example arrangement in which disassembled modules (the first module 100, first sub module 220, bridge fin 240) may be located in, and distributed between cargo aircraft 600. Hence the watercraft system 10 can be broken down into the individual hull modules and positioned in one or more transport vehicles. Hence once disassembled the watercraft system 10 modules, including the hull modules and equipment modules 500, may be transported in an aircraft, by lorry or train or in another water vessel as required, where space in the transport vehicle would otherwise be too limited to accommodate the assembled watercraft system 10.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A watercraft system, wherein the watercraft system is a submarine or a submersible configured to be submerged in water, the watercraft system comprising:

a hull having a longitudinal axis which extends between an aft end and a forward end, the hull comprising at least a first hull module and a second hull module, wherein the first hull module defines the aft end and a first interface element which defines a first hull module opening, the second hull module defines the forward end and a second interface element which defines a second hull module opening, the first interface element and second interface element being configured to couple with each other to form a sealed joint, and the first interface element and second interface element being configured to be uncoupled from one another;

the watercraft system being operable with the first interface element of the first hull module coupled to the second interface element of the second hull module; and the watercraft system being operable with the first hull module and the second hull module coupled together by a third hull module provided between the first hull module and the second hull module, wherein each of the first hull module and second hull module is configured to be uncoupled from the third hull module, wherein:

at least one of the hull modules is provided with a mounting rail for carrying the equipment module, the mounting rail extending in a direction aligned with, or parallel to, the longitudinal axis along an inside of the respective hull module;

the equipment module is slidable along the mounting rail to move in a direction along the longitudinal axis into and out of the respective opening in the respective hull module;

the equipment module and the mounting rail are configured to be engaged with one another to secure the equipment module and mounting rail together; and the equipment module and mounting rail are configured to be disengaged from one another so that the equipment module can be removed from the respective hull module in a direction along the longitudinal axis.

2. The watercraft system of claim 1, wherein:

the hull comprises the third hull module, the third hull module having two ends;

the third hull module having a third interface element at one end which defines a third hull module first opening and a fourth interface element at the other end which defines a third hull module second opening;

the first interface element of the first hull module is configured to couple with the fourth interface element of the third hull module to form a sealed joint;

the first interface element of the first hull module is configured to be uncoupled from the fourth interface element of the third hull module;

the second interface element of the second hull module is configured to couple with the third interface element of the third hull module to form a sealed joint; and the second interface element of the second hull module is configured to be uncoupled from the third interface element of the third hull module.

3. The watercraft system of claim 1, wherein:

the second hull module comprises a first sub-module and second sub-module;

the first sub-module having a fifth interface element which defines a first sub-module opening;

the second sub-module having a sixth interface element which defines a second sub-module opening;

the fifth interface element of the first sub-module and the sixth interface element of the second sub-module being configured to couple with each other to form a sealed joint; and the fifth interface element of the first sub-module and the sixth interface element of second sub-module being configured to uncouple from each other.

4. The watercraft system claim 3, wherein the first hull module and the second hull module first sub-module are provided in series along the longitudinal axis; and wherein:

the second hull module second sub-module extends from the second hull module first sub-module in a direction perpendicular to the longitudinal axis; and/or the second hull module second sub-module is a bridge fin.

5. The watercraft system of claim 1, wherein adjacent interface elements of the hull modules are coupled by a fixing means; wherein:

the fixing means has a first configuration in which the adjacent interface elements are coupled with one another; and the fixing means has a second configuration in which the adjacent interface elements are operable to be uncoupled from one another.

6. The watercraft system of claim 5, wherein the fixing means includes a threaded nut and threaded bolt, and/or an assembly of a threaded bolt, a reaction nut and a tension nut.

7. The watercraft system of claim 1, wherein the equipment module comprises a support structure and an equipment unit, the equipment unit mounted to the support structure; and wherein the equipment unit may comprise one of:

a power plant;

an engine;

a battery;

instrumentation;

control equipment;

furniture; or crew quarters.

8. The watercraft system of claim 7, wherein the support structure is operable to engage with and slide along the mounting rail.

9. A method of operation of a watercraft system, wherein the watercraft system is a submarine or a submersible configured to be submerged in water;

the watercraft system comprising a hull having a longitudinal axis which extends between an aft end and a forward end;

the hull comprising at least a first hull module and a second hull module;

wherein the first hull module defines the aft end, and a first interface element which defines a first hull module opening; and the second hull module defines the forward end and a second interface element which defines a second hull module opening;

the method comprising:

coupling the first interface element and second interface element to form a sealed joint; and/or uncoupling the first interface element and second interface element and separating the first and second hull modules, wherein the watercraft system further comprises a mounting rail for carrying an equipment module, the mounting rail extending in a direction aligned with, or parallel to, the longitudinal axis along an inside of a respective one of the first or second hull module, and the method further comprises, prior to coupling the first interface element and the second interface element:

entering a first equipment module through the respective opening in the respective hull module and sliding the first equipment module along the mounting rail to move in a direction along the longitudinal axis; and locking the equipment module in position relative to the respective hull module, removing the first equipment module from the respective hull module by sliding the first equipment module along the mounting rail to move in a direction along the longitudinal axis out of the respective opening in the respective hull module;

entering a second equipment module through the respective opening in the respective hull module and sliding the second equipment module along the mounting rail to move in a direction along the longitudinal axis; and locking the second equipment module in position relative to the respective hull module.

10. The method of claim 9, further comprising:

uncoupling the first interface element and second interface element and separating the first and second hull modules;

providing a third hull module having a third interface element at one end which defines a third hull module first opening and a fourth interface element at the other end which defines a third hull module second opening;

coupling the first interface element of the first hull module with the fourth interface element of the third hull module to form a sealed joint; and coupling the second interface element of the second hull module with the third interface element of the third hull module to form a sealed joint.

11. The method of claim 9, comprising uncoupling the first interface element and second interface element, separating the first and second hull modules, and transporting the first and second hull modules in a dis-assembled state.

12. The watercraft system of claim 2, wherein:

the second hull module comprises a first sub-module and second sub-module;

the first sub-module having a fifth interface element which defines a first sub-module opening;

the second sub-module having a sixth interface element which defines a second sub-module opening;

the fifth interface element of the first sub-module and the sixth interface element of the second sub-module being configured to couple with each other to form a sealed joint; and the fifth interface element of the first sub-module and the sixth interface element of second sub-module being configured to uncouple from each other.

13. The watercraft system claim 12, wherein the first hull module, the third hull module, and the second hull module first sub-module are provided in series along the longitudinal axis; and wherein:

the second hull module second sub-module extends from the second hull module first sub-module in a direction perpendicular to the longitudinal axis; and/or the second hull module second sub-module is a bridge fin.

14. A watercraft system, wherein the watercraft system is a submarine or a submersible configured to be submerged in water, the watercraft system comprising:

a hull having a longitudinal axis which extends between an aft end and a forward end, the hull comprising at least a first hull module and a second hull module, wherein the first hull module defines the aft end and a first interface element which defines a first hull module opening, the second hull module defines the forward end and a second interface element which defines a second hull module opening, the first interface element and second interface element being configured to couple with each other to form a sealed joint, and the first interface element and second interface element being configured to be uncoupled from one another;

an equipment module; and a mounting rail for carrying the equipment module, the mounting rail extending in a direction aligned with, or parallel to, the longitudinal axis along an inside of one or both of the first hull module and second hull module;

wherein the equipment module includes a support structure and an equipment unit, the equipment unit mounted to the support structure, wherein the support structure is operable to engage with and slide along the mounting rail to move in a direction along the longitudinal axis into and out of the respective opening in the respective hull module;

the watercraft system being operable with the first interface element of the first hull module coupled to the second interface element of the second hull module; and the watercraft system being operable with the first hull module and the second hull module coupled together by a third hull module provided between the first hull module and the second hull module, wherein each of the first hull module and second hull module is configured to be uncoupled from the third hull module, and wherein:

at least one of the hull modules is provided with a mounting rail for carrying the equipment module, the mounting rail extending in a direction aligned with, or parallel to, the longitudinal axis along an inside of the respective hull module;

the equipment module is slidable along the mounting rail to move in a direction along the longitudinal axis into and out of the respective opening in the respective hull module;

the equipment module and the mounting rail are configured to be engaged with one another to secure the equipment module and mounting rail together; and the equipment module and mounting rail are configured to be disengaged from one another so that the equipment module can be removed from the respective hull module in a direction along the longitudinal axis.

15. The watercraft system of claim 14, wherein:

the hull comprises the third hull module, the third hull module having two ends;

the third hull module having a third interface element at one end which defines a third hull module first opening and a fourth interface element at the other end which defines a third hull module second opening;

the first interface element of the first hull module is configured to couple with the fourth interface element of the third hull module to form a sealed joint;

the first interface element of the first hull module is configured to be uncoupled from the fourth interface element of the third hull module;

the second interface element of the second hull module is configured to couple with the third interface element of the third hull module to form a sealed joint; and the second interface element of the second hull module is configured to be uncoupled from the third interface element of the third hull module.

16. The watercraft system of claim 14, wherein:

the second hull module comprises a first sub-module and second sub-module;

the first sub-module having a fifth interface element which defines a first sub-module opening;

the second sub-module having a sixth interface element which defines a second sub-module opening;

the fifth interface element of the first sub-module and the sixth interface element of the second sub-module being configured to couple with each other to form a sealed joint; and the fifth interface element of the first sub-module and the sixth interface element of second sub-module being configured to uncouple from each other.

* * * * *